US006381849B2

(12) United States Patent
Eichhorn et al.

(10) Patent No.: US 6,381,849 B2
(45) Date of Patent: May 7, 2002

(54) DRY SHAVING APPARATUS

(75) Inventors: Reinhold Eichhorn, Idstein; Michael Harms, Oberursel; Sebastian Hottenrott, Istein; Peter Junk, Schmitten; Michael Odemer; Jens Störkel, both of Frankfurt; Jürgen Wolf, Kriftel, all of (DE)

(73) Assignee: Braun GmbH, Frankfurt (DE)

( * ) Notice: Subject to any disclaimer, the term of this patent is extended or adjusted under 35 U.S.C. 154(b) by 0 days.

(21) Appl. No.: 09/766,682

(22) Filed: Jan. 18, 2001

Related U.S. Application Data

(63) Continuation of application No. PCT/EP99/04447, filed on Jun. 26, 1999.

(30) Foreign Application Priority Data

Jul. 20, 1998 (DE) ..... 198 32 475

(51) Int. Cl.[7] ..... B26B 19/04
(52) U.S. Cl. ..... 30/43.92; 30/346.51
(58) Field of Search ..... 30/43.1, 34.1, 30/43, 43.9, 43.92, 346.51

(56) References Cited

U.S. PATENT DOCUMENTS

| | | | | | |
|---|---|---|---|---|---|
| 3,748,732 A | | 7/1973 | Frantz et al. | ..... | 30/43.1 |
| 3,997,969 A | * | 12/1976 | Czerner et al. | ..... | 30/43.92 |
| 4,110,906 A | * | 9/1978 | Boer et al. | ..... | 30/43.92 |
| 4,604,801 A | | 8/1986 | Ullmann et al. | ..... | 30/43.92 |
| 4,631,825 A | | 12/1986 | Kuriyama et al. | ..... | 30/43.92 |
| 5,163,227 A | * | 11/1992 | Wolf et al. | ..... | 30/43.92 |
| 5,542,179 A | | 8/1996 | Beutel | ..... | 30/43.92 |
| 5,669,138 A | * | 9/1997 | Wetzel | ..... | 30/43.92 |
| 6,098,289 A | | 8/2000 | Wetzel et al. | ..... | 30/43.92 |
| 6,205,666 B1 | * | 3/2001 | Junk | ..... | 30/43.92 |
| 6,219,920 B1 | * | 4/2001 | Klein | ..... | 30/43.92 |

FOREIGN PATENT DOCUMENTS

| | | | | |
|---|---|---|---|---|
| EP | 0 161 508 A1 | 11/1985 | ..... | B26B/19/38 |
| EP | 0 378 266 A1 | 7/1990 | ..... | B26B/19/48 |
| EP | 0 673 728 A1 | 9/1995 | ..... | B26B/19/04 |
| GB | 2 036 631 | 7/1980 | ..... | B26B/19/04 |

* cited by examiner

*Primary Examiner*—Hwei-Siu Payer
(74) *Attorney, Agent, or Firm*—Edward S. Podszus

(57) ABSTRACT

The invention is directed to a dry shaving apparatus with an electric drive mechanism (A) provided in a housing (1) and a housing part (G) in which a removable frame (WR) equipped with at least one cutter element (S) is held by at least one detent mechanism (R), wherein upon release of the removable frame (WR) by the detent mechanism (R) the removable frame (WR) is movably held in a holding position by a retaining device (HV), wherein in said holding position provision is made for at least one distance (W, W1) between a wall of the removable frame (WR) and a wall of the housing part (G), and the removable frame (WR) is adapted to be set in motion by the drive mechanism (A).

72 Claims, 8 Drawing Sheets

35
43
21
HV
S
P
33
51
31
29
55
56
50
30
49
46
V
V
22
26
K
KHS
47
48
25
LHS
32
KHS
34
WR

KHS
LHS
KHS
26
49
46
35
43
51
50
25
30
56
55
31
HV
32
51
30
HV
50
56
55
31
33
WR
21
22
22
48
K
47
29

DRY SHAVING APPARATUS

This is a continuation of International Application No. PCT/EP99/04447, pending, with an International filing date of Jun. 26, 1999.

FIELD OF THE INVENTION

This invention relates to a dry shaving apparatus.

DISCUSSION OF PRIOR ART

A dry shaving apparatus of the type initially referred to is known from printed specification EP 0 161 508 B1. A shaving foil acting as a cutter element is attached to the removable frame in arched form. The removable frame with the shaving foil is arranged between two end cheeks of a housing part and detachably held by a detent mechanism provided in the end walls. The housing part holding the removable frame may be constructed as a component part of the housing of the dry shaving apparatus or it may be a separate housing part adapted to be coupled to and decoupled from the housing of the dry shaving apparatus.

From EP 0 673 728 B1 a dry shaving apparatus with a housing part provided on the housing is known. Demountably held between the end walls of the housing part by two detent mechanisms is a removable frame equipped with two cutter elements in order to ensure both the replacement of a defective removable frame and the cleaning of the complete shaving head, in particular the hair dust collecting chamber formed by the inner walls of the removable frame and the walls of the housing part enclosed by the removable frame, including the cleaning of the cutter elements provided by means of suitable cleaning brushes.

BACKGROUND

In this known dry shaving apparatus it is necessary for the shaving head of the dry shaving apparatus to be disassembled into several parts. When these parts which include, for example, the removable frame, the undercutter, the coupling element and the housing part of the shaving head are placed down in a bathroom sink, scattered soiling by hair dust occurs. When the user turns the dry shaving apparatus on with the removable frame demounted but the undercutter engaged, dislodged hair dust will be distributed over a major area of the sink.

It is an object of the present invention to effect cleaning of the shaving head, meaning the hair dust collecting chamber formed by the housing part and the removable frame and also the cutter elements provided, in particular the cutter elements utilized as undercutters, in simple manner and with minimum effort.

SUMMARY OF THE INVENTION

According to the present invention a dry shaving apparatus of the invention affords plural advantages, including for example, that actuation of the actuating device initially disengages the removable frame from the housing part for the frame to be subsequently movably held in a holding position by a retaining device, in which position at least one distance is maintained between at least one wall of the removable frame and at least one wall of the housing part, so that both the movability of the removable frame and the falling out of hair dust from the hair dust collecting chamber are ensured by this distance. To be able to perform at any time, such as daily, a basic cleaning operation of the shaving head which involves the removal of hair dust clinging to the walls of the housing part, the walls of the removable frame and the cutter elements from the hair dust collecting chamber without having to detach the removable frame from the housing part, the invention provides for setting the removable frame in motion by operation of the electric drive mechanism when the removable frame is held in the holding position by the retaining device, so that it is through this movement of the removable frame and the drive elements setting the removable frame in motion that the hair dust clinging to the walls of the removable frame, the cutter elements and the walls of the housing part is dislodged or dislodged to the maximum possible extent for it to fall out of the distances formed, whereby the removal of hair dust from the hair dust collecting chamber is optimized.

Accordingly, the present invention ensures a basic cleaning of the shaving head without the need to take the shaving head apart as by detaching the removable frame and decoupling existing undercutters from drive elements, for subsequent cleaning of these parts manually using a brush or the like. The hair dust which, according to the invention, falls out of the hair dust collecting chamber through the distance produced between the removable frame and a wall of the housing part, concentrates on a small area, for example, in a sink, to be disposed of by means of water, whilst heretofore several places or areas of a sink have been subject to soiling by the placing down and cleaning of component parts with adhering hair dust.

In a further aspect of this embodiment of the invention, provision is made for the removable frame to be detachably held by the retaining device. This arrangement initially ensures the exchange or replacement of removable frames which have become defective in the course of use, in addition to enabling the heretofore usual cleaning operation of the hair dust collecting chamber to be accomplished, including the cleaning of existing cutter elements of the shaving head to the extent this should become necessary for any reasons.

In one embodiment of the invention, in the holding position of the removable frame provision is made for a distance between a wall of the housing central portion and a wall of at least one bar of the removable frame. A further embodiment is characterized in that in the holding position of the removable frame provision is made for a distance between an end wall of the removable frame and an end wall of the housing part. According to a preferred embodiment of the invention, the distance is producible by shaping adjacent walls of the housing part and of the removable frame differently. According to a further preferred embodiment of the invention, the distance is producible by constructing at least one wall of the housing part in wedge shape to ensure detachment of the removable frame from the housing part. In another embodiment of the invention, the distance is producible by constructing at least one wall of the housing part and an adjacent wall of the removable frame in wedge shape to ensure detachment of the removable frame from the housing part. In a further aspect of this embodiment, at least one end wall of the housing part is of a wedge-shaped configuration. In a further aspect of the last mentioned embodiment, at least one end wall of the removable frame is of a wedge-shaped configuration. In a preferred embodiment of the invention, at least one end wall of the removable frame and at least one end wall of the housing part are of a wedge-shaped configuration. It is an essential advantage of previously mentioned constructions of adjacent walls of the housing part and the removable frame that the distance required both for moving the removable frame in the holding position maintained by the retaining device and for the falling out of hair dust from the hair dust collecting chamber is producible simply and economically merely by suitably adapting the respective wall shapes of the housing part and the removable frame.

To dislodge the hair dust from the walls defining the hair dust collecting chamber and also from the cutter elements rapidly and efficiently, one embodiment of the invention provides for the electric drive mechanism to be adapted to be coupled via a coupling element to at least one cutter element and also, by means of cooperating retaining elements of the retaining device, to the removable frame. In this way it is ensured that operation of the electric drive mechanism transmits the driving motion to the removable frame, causing it to oscillate for dislodging the hair dust.

In a preferred embodiment of the present invention, the removable frame held by the retaining device is adapted to be set in motion by a drivable cutter element.

To enhance the cleaning effect, one embodiment of the invention makes provision for a stop on at least one end wall of the removable frame, said stop being acted upon in pulse fashion by a drivable cutter element. By means of this stop the movements of the cutter element are transmitted to the removable frame in a directionalized, pulse-type fashion.

In a further embodiment of the invention a stop is provided on at least one outer surface of the removable frame, said stop acting upon an end wall of the housing part in pulse fashion. With this arrangement the pulse-type impact of a cutter element on the removable frame is transmitted to the housing part, thereby enhancing the dislodging of hair dust from the walls of the housing part in advantageous manner.

In another embodiment of the invention provision is made for the retaining device to be formed of at least two retaining elements adapted to be coupled to each other. In a further aspect of this embodiment, one of the retaining elements is provided on a coupling element, and a further retaining element on a drivable cutter element. In a further aspect of this last-mentioned embodiment, the retaining element is provided on a coupling element of a movable cutter element. Preferably, this retaining element is of a fork-shaped shaped configuration. In another aspect of this embodiment of the invention, the fork arms of the retaining element are resilient. Preferably, in the area of the opening of the fork arms provision is made for retaining beads reducing the width of the fork opening. One significant advantage of such a construction of cooperating retaining elements resides first in the simplicity of construction, considering that the retaining elements are formed on anyway necessary components of the dry shaving apparatus. The area between the resilient fork arms ensures the movement of the removable frame necessary for cleaning the shaving head and, in addition, the formation of a distance between removable frame and housing part.

A substantial advantage of the invention resides in that the movement of the removable frame, which is necessary to perform the cleaning function, is effected by a cutter element which, with the removable frame and the housing part in locked condition, is required to perform another function, namely the cutting of hairs. In a preferred embodiment of the invention, the cutter element is constructed as the undercutter of a short hair cutter unit. In an alternative embodiment, the cutter element is constructed as the undercutter of a long hair cutter unit.

Further advantageous arrangements relating to the design of coupling elements and the detent mechanism detachably holding the removable frame on the housing part will become apparent from the following description.

Embodiments of the present invention will be described in more detail in the following with reference to the accompanying drawings.

BRIEF DESCRIPTION OF THE INVENTION

DETAILED DESCRIPTION OF THE PREFERRED EMBODIMENTS

Figure 1:
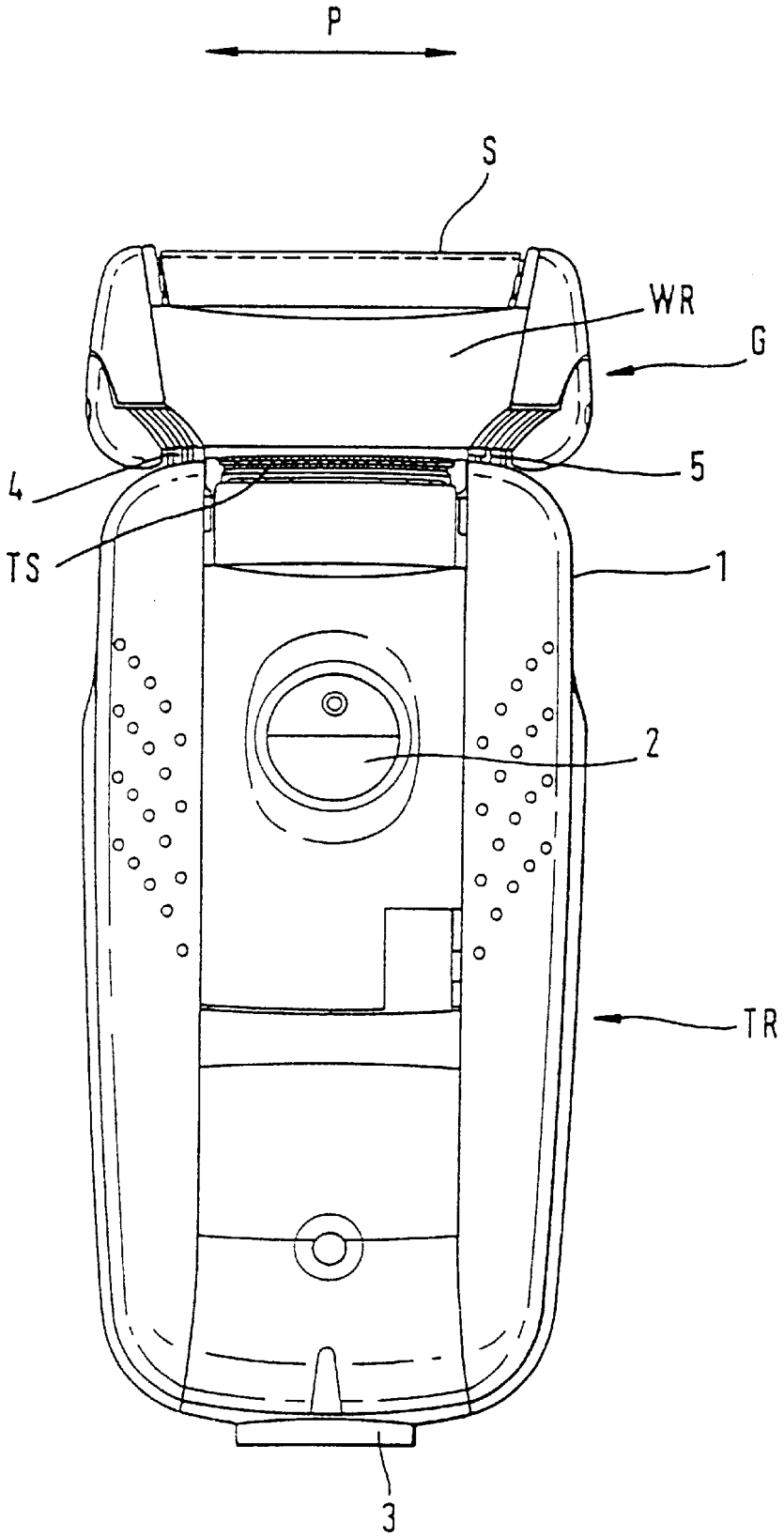
FIG. 1 is a front view of a dry shaving apparatus with a shaving head arranged on a housing and comprising a housing part and a removable frame with cutter element.

FIG. 1 shows a dry shaving apparatus TR with a housing 1 having arranged in its front panel an actuating switch 2 and an adjustably mounted trimmer unit TS. Provided in the bottom wall of the housing 1 is a socket 3 for connection to a power supply cord. Seated on the housing 1 is a shaving head having detachably secured in its housing part G a removable frame WR comprising at least one cutter element S. The housing part G of the shaving head is coupled to the housing by means of two supporting elements 4 and 5. Together with the housing part G the supporting elements 4 and 5 are mounted in the housing 1 for back-and-forth movement in the directions of arrow P. In another embodiment the supporting elements 4, 5 are immovably secured in or on the housing 1.

Figure 2:
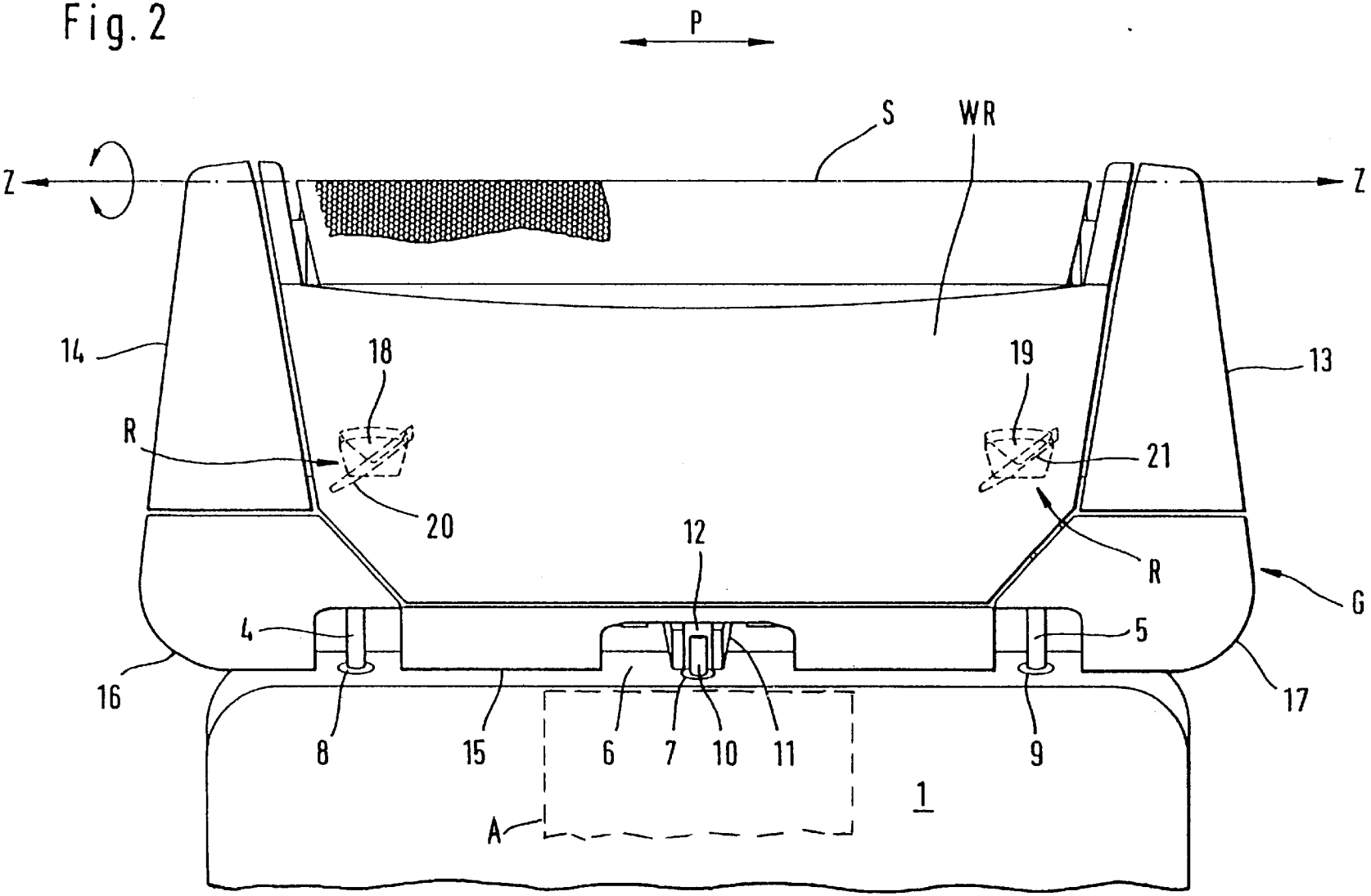
FIG. 2 is a view of the upper part of the housing of a dry shaving apparatus having arranged above it a shaving head with a removable frame shown locked with the housing part.

FIG. 2 shows the upper part of the housing 1 having in its upper side 6 several apertures 7, 8, 9 for passage of the supporting elements 4 and 5 projecting from the housing and a drive pin 10 of an electric drive mechanism A arranged in the housing 1. The drive pin 10 makes engagement with a groove 12 of a coupling element 11 for transmission of a drive motion reciprocating in the directions of arrow P to a cutter element S mounted for oscillatory motion in the housing part G via a coupling element K—see FIG. 3. The housing part G is comprised of two opposed end walls 13, 14 and a housing central portion 15 carrying the end walls. Detachably held between the two end walls 13 and 14 by means of detent mechanisms R is a removable frame WR. The removable frame WR receives at least one cutter element S and/or one cutter unit comprised of two cooperating cutter elements.

In the embodiment of FIG. 2 the housing part G of the shaving head is mounted on the supporting elements 4 and 5 for pivotal movement about a pivot axis Z—Z. To this effect, the supporting elements 4 and 5 protrude into the interior of the end walls 13 and 14 to ensure pivotability of the shaving head in the area of the pivot axis Z—Z by means of a pivot bearing—not shown. In another embodiment the housing part G of the shaving head may be rigidly secured to the housing 1 of the dry shaving apparatus or it may be constructed as a component part of the housing—not shown. The supporting elements 4 and 5 are either rigidly secured in the housing 1 or, in an alternative embodiment, mounted for movement at least in the directions of arrow P. Provided on the housing part G are two pushbuttons 16, 17 which, when actuated, enable the removable frame WR to be unlocked for the purpose of detaching it.

Figure 3:
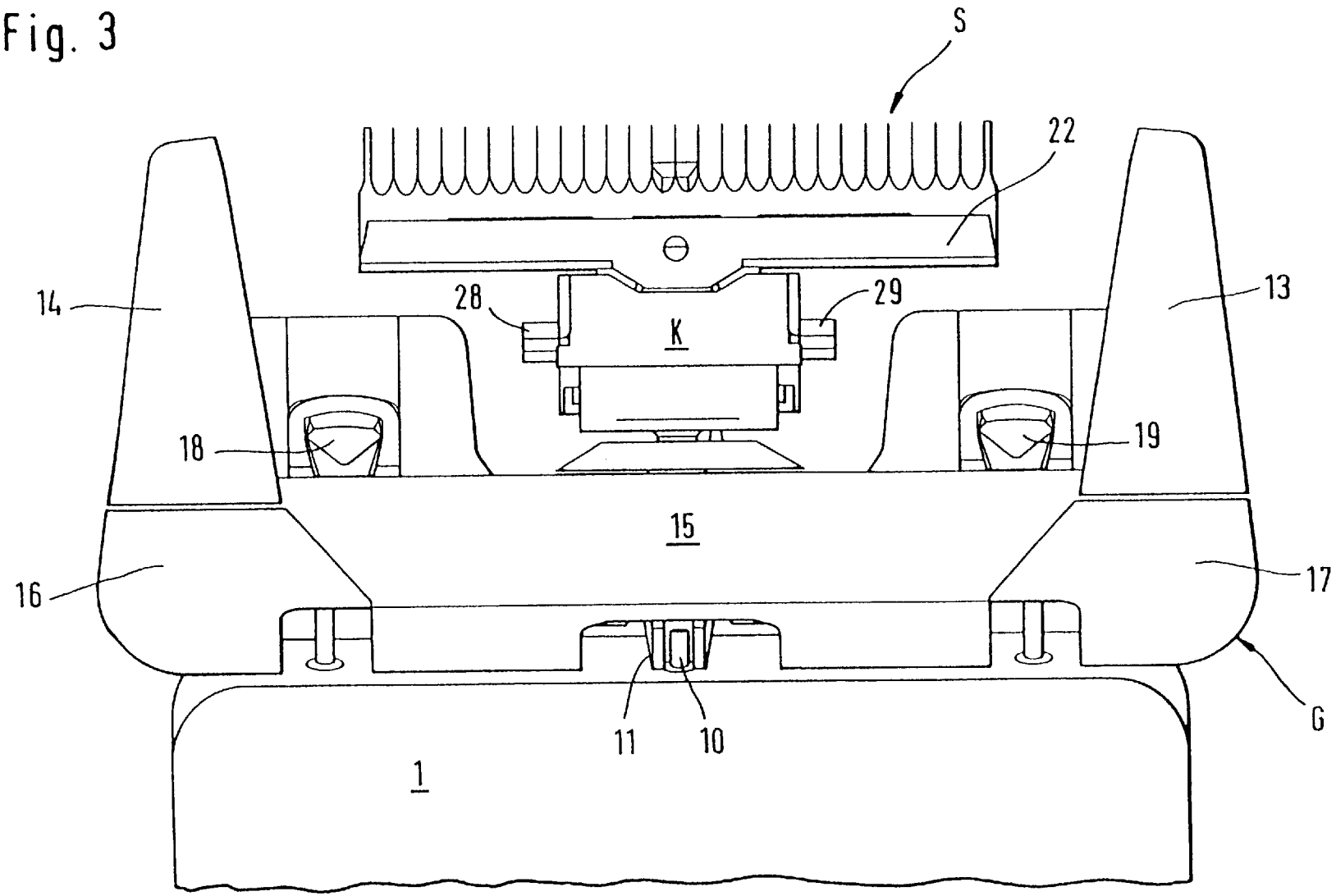
FIG. 3 is a view of the upper part of the housing of a dry shaving apparatus with a housing part arranged above it, but absent a removable frame.

FIG. 3 shows the upper part of the housing 1 with a housing part G disposed thereon but with the removable frame WR detached to reveal further components of the shaving head and their arrangement in the housing part G. Resiliently mounted adjacent to the end walls 13 and 14 in the housing central portion 15 are respective detent elements 18 and 19. A cutter element S constructed as undercutter 22 is arranged on a coupling element K between the two end walls 13 and 14. The coupling element K is movably arranged in the housing central portion 15 and coupled to the coupling element 11 for transmission of the drive motion of the drive pin 10. Two retaining elements 28 and 29 are provided on the coupling element K, with the retaining element 28 extending in the direction of the end wall 14 while the retaining element 29 extends in the direction of the end wall 13.

Figure 4:
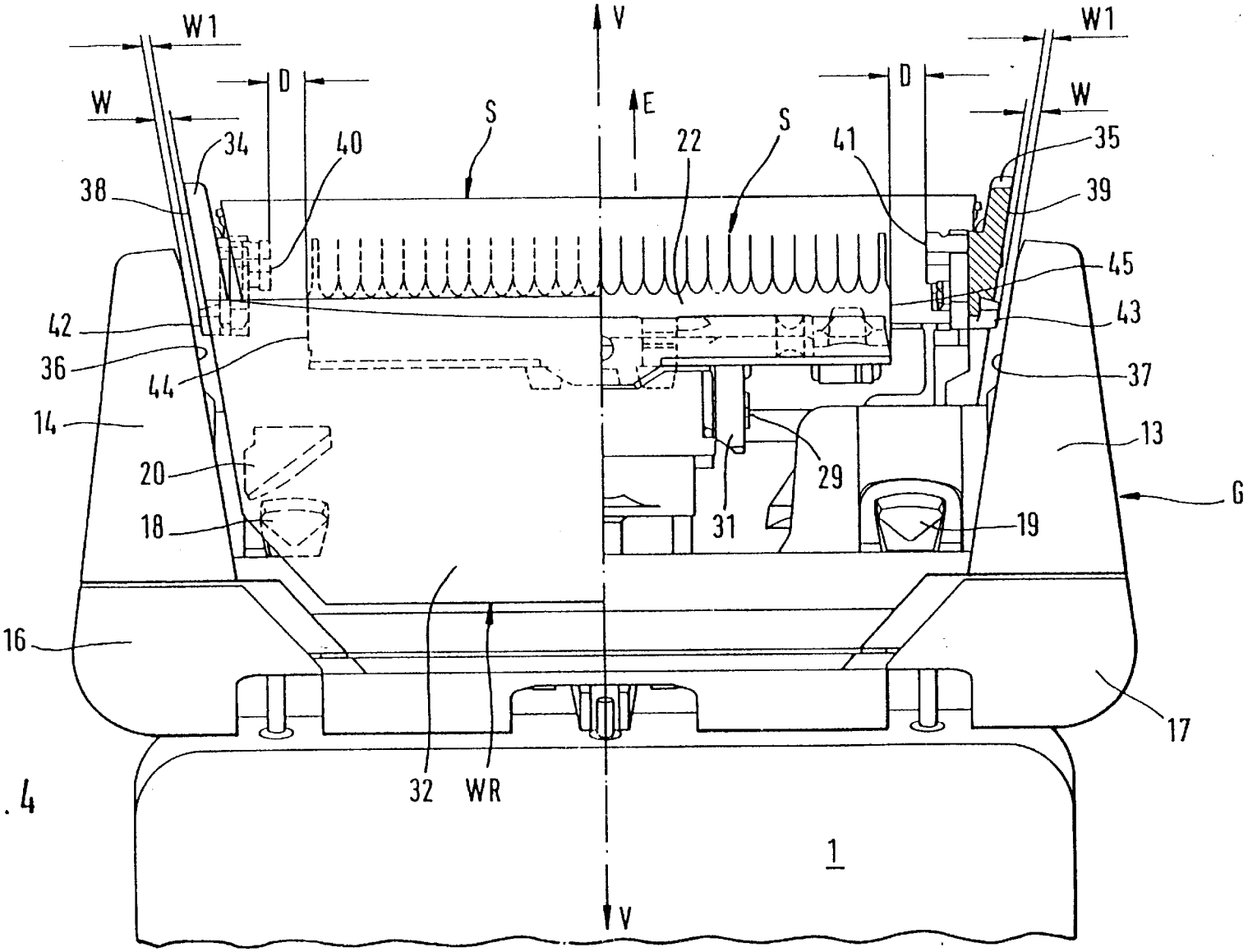
FIG. 4 is a view of the upper part of the housing of a dry shaving apparatus with a shaving head arranged above it and a removable frame unlocked from the housing part, yet held in a holding position.

FIG. 4 shows the upper part of the housing 1 with a housing part G arranged thereon and a removable frame WR detachable in the direction of withdrawal indicated by the direction of arrow E, with the one bar 32 of the removable frame WR and the outer cutter coupled thereto being shown in part only. The removable frame WR is illustrated in a condition in which it is held by the retaining elements 28 and 29 being embraced by retaining elements 30 and 31—see also FIG. 5. With the removable frame WR in unlocked condition, the detent elements 18, 19 are disengaged from the detent notches 20, 21 provided in the removable frame WR, as shown, for example, in FIG. 4 by the broken lines representing the detent element 18 and the detent notch 20.

Figure 5:
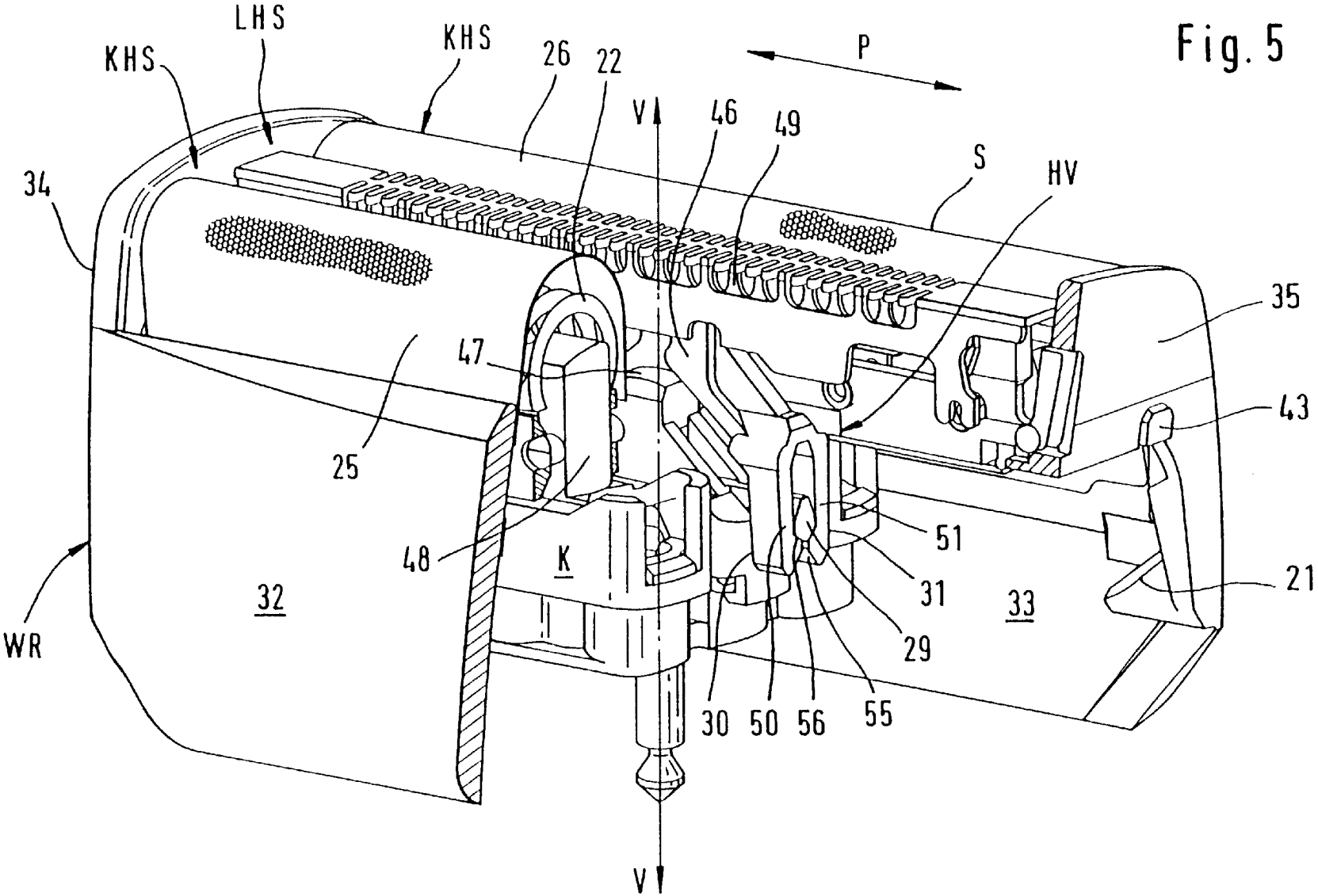
FIG. 5 is a perspective view of the removable frame in which a long hair cutter unit is provided between two outer cutters, attached in arched form, of a respective short hair cutter unit, and a sectional view of a bar, an undercutter and an end wall of the removable frame.

The removable frame WR is essentially comprised of two bars 32 and 33 extending in the longitudinal direction—direction of arrow P—and end walls 34 and 35 connecting the bars 32 and 33—see FIG. 5—, as well as at least one cutter element S seated between the bars 32, 33 and the end walls 34, 35. The inner surfaces 36 and 37 of the end walls 13 and 14 and the outer surfaces 38 and 39 of the end walls 34 and 35 extend in a wedge-shaped configuration relative to the vertical center axis V of the dry shaving apparatus TR, such that the relative distance of the end walls 13 and 14 in the area of the housing central portion 15 is smaller than the relative distance of the end walls 13 and 14 at the level of the cutter element S. This shape has the result that with the removable frame WR locked with the housing part G, the end walls 34 and 35 touch or nearly touch the inner surfaces 36 and 37 of the end walls 13 and 14. In unlocked condition in which the removable frame WR is initially held by the retaining elements 28 to 31, the end walls 34 and 35 are at a small relative distance W to the inner surfaces 36 and 37 and also the longitudinal side walls 53, 54 of the housing part G—see also FIG. 8.

Provided on either end wall 34 and 35 is an inwardly extending stop 40 and 41, respectively, and an outwardly extending stop 42 and 43, respectively. The outer shape of the stops 40 and 41 on the side close to the undercutter 22 and the shape of the longitudinal ends 44 and 45 of the undercutter 22 and the positioning of the stops 40 and 41 on the removable frame WR in cooperation with the undercutter 22 are adjusted relative to each other in such manner that, with the removable frame WR locked with the housing part G, the stops 40 and 41 are able to slide into the undercutter 22 without adversely affecting the undercutter's oscillating motion.

Operation of the pushbuttons 16, 17 unlocks the removable frame WR. The removable frame WR sliding with its detent notches 20, 21 over and past the detent elements 18, 19 is then movably held in a predetermined holding position by resilient arms of the retaining elements 30, 31 partially embracing the retaining elements 28, 29.

Once the removable frame WR is transferred to the holding position, the wedge shapes of the outer surfaces 38, 39 of the removable frame and the inner surfaces 36, 37 of the end walls 13, 14 extending parallel thereto result in a distance W between the respective inner surface 36, 37 and the respective outer surface 38, 39. Each distance W ensures initially a back-and-forth movement of the removable frame WR in the directions of arrow P, in addition to providing a gap allowing the passage of hair dust, if any. Furthermore, between at least one of the longitudinal side walls 53, 54 of the housing part G and at least one of the bars 32, 33 of the removable frame WR at least one other slit-shaped distance W for the passage of hair dust is produced.

The distance W may be constructed as a slit-type circumferential gap resulting from the transfer of the removable frame WR from the locked position to the holding position, which gap may be of uniform size or, alternatively, of different dimensions.

By virtue of the transfer of the removable frame WR to the holding position, the two stops 40, 41 occupy a position altered relative to the undercutter 22, in which position the stops 40, 41 are prevented from entering the undercutter 22. The distance D of the respective longitudinal ends 44, 45 relative to the stops 40, 41 is dimensioned such as to ensure that, with an undercutter 22 set in oscillation by activation of the electric drive mechanism, the longitudinal ends 44, 45 of the undercutter 22 act upon the stops 40, 41 in pulse fashion in order to effect a back-and-forth or shaking movement of the removable frame WR in the direction of motion direction of arrow P—of the undercutter 22. By means of the pulses impacting on the removable frame WR by the undercutter 22, the relatively fine hair dust becomes dislodged from the walls of the removable frame WR, the undercutter 22 and the walls of the housing part G, falling, with the dry shaving apparatus TR held horizontally, for example, through the apertures, as through the slits defined by the distances W, formed between the housing part G and the walls of the removable frame WR to the outside.

The cleaning of all the walls enclosed by the removable frame WR may be optimized by a further arrangement. To accomplish this, the outwardly extending stops 42, 43 are provided on the end walls 34, 35 of the removable frame WR, by means of which stops the distance W of the outer surfaces 38, 39 of the removable frame WR relative to the inner surfaces 36, 37 of the end walls 13, 14 is reduced to a gap W1 whose width is to be determined and fixed under practical considerations applicable to the case in question, here the construction of a shaving head. The stops 42, 43 are effective to transmit the pulses impacting on the stops 40, 41 by an oscillating undercutter 22 to the end walls 13, 14 of the housing part G in order to effect likewise a vibration aimed to support the cleaning process.

FIG. 5 shows a perspective view of the removable frame WR in which a long hair cutter unit LHS comprised of an outer cutter and an undercutter with a coupling element is positioned between two outer cutters 25, 26, attached in arched form, of a respective short hair cutter unit KHS, and also a sectional view of the bar 32, the undercutter 22 and the end wall 35, such as to reveal the coupling element K transmitting the drive motion to the respective undercutters of short hair cutter unit KHS and long hair cutter unit LHS, together with the retaining device HV holding the removable frame WR. Formed on the housing wall of the coupling element K are the retaining elements 28, 29 of which the retaining element 29 is shown. The coupling element K which is adapted to be set in a reciprocating motion by the electric drive mechanism A of the dry shaving apparatus TR is coupled via two drive elements 48—of which only one is shown—in a driving relationship to the respective undercutter 22 of the two short hair cutter units KHS provided in the removable frame WR, and via the drive element 47 and the coupling element 46, to the undercutter 49 of the long hair cutter unit LHS positioned between the short hair cutter units KHS. Formed at either end of the fork-shaped coupling element 46—see FIG. 6—is a respective retaining device HV, with the relative distance of the fork ends being dimensioned such that these, upon embracing the retaining elements 28 and 29, make engagement with the wall of the housing of the coupling element K. The retaining device HV is of a fork-shaped construction, having bead-type projections formed on the ends of the fork arms 50, 51, which in their capacity as retaining beads 55, 56 are spaced from each other a specific relative distance. The fork arms 50 and 51 of the retaining elements 30 and 31 are elastic so as to ensure withdrawal of the removable frame WR from the housing part G, which is accomplished by the fork arms 50 and 51 with their integrally formed retaining beads 55, 56 spreading apart elastically in accordance with the dimensions of the retaining elements 28 and 29. The embodiment of FIG. 5 shows the removable frame WR in the holding position illustrated in FIG. 4 in which the detent elements 18 and 19 are disengaged from the detent notches 20 and 21. In this holding position the slit formed by the fork arms 50 and 51 and bounded by the retaining beads 55, 56 ensures clearance of movement for the removable frame WR driven by the coupling element K. Formed on the end wall 35 is a stop 43 by means of which the oscillating motion of the removable frame is transmittable to the end wall 13 of the housing part G.

Figure 6:
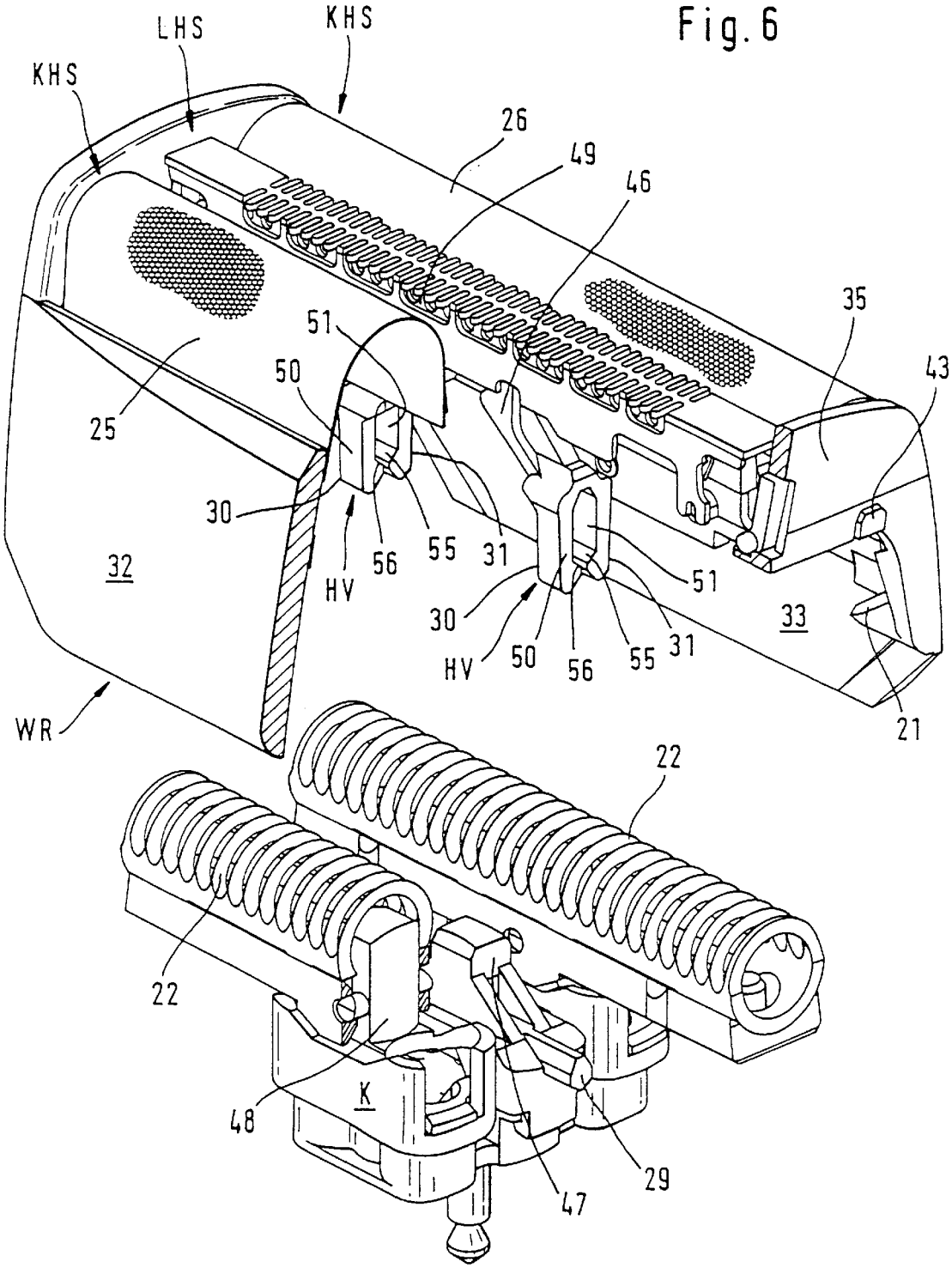
FIG. 6 is an exploded view of the coupling element, the undercutters coupled thereto and the removable frame, showing also a part sectional view of a bar and an end wall of the removable frame.

FIG. 6 shows an exploded view of the coupling element K, the undercutters 22 coupled thereto and the removable frame WR, including a part sectional view—see also FIG. 4 and FIG. 5—of the bar 32 and the end wall 35 of the removable frame WR. The drive element 47 for the undercutter 49 of the long hair cutter unit is provided between the two undercutters 22 coupled to the coupling element K and associated with the outer cutters 25 and 26. The undercutter 49 is adapted to be coupled to the drive element 47 via the coupling element 46 for setting the long hair cutter unit in operation. Integrally formed at either end of the fork-shaped coupling element 46 is the retaining device HV with its fork arms 50 and 51.

Figure 7:
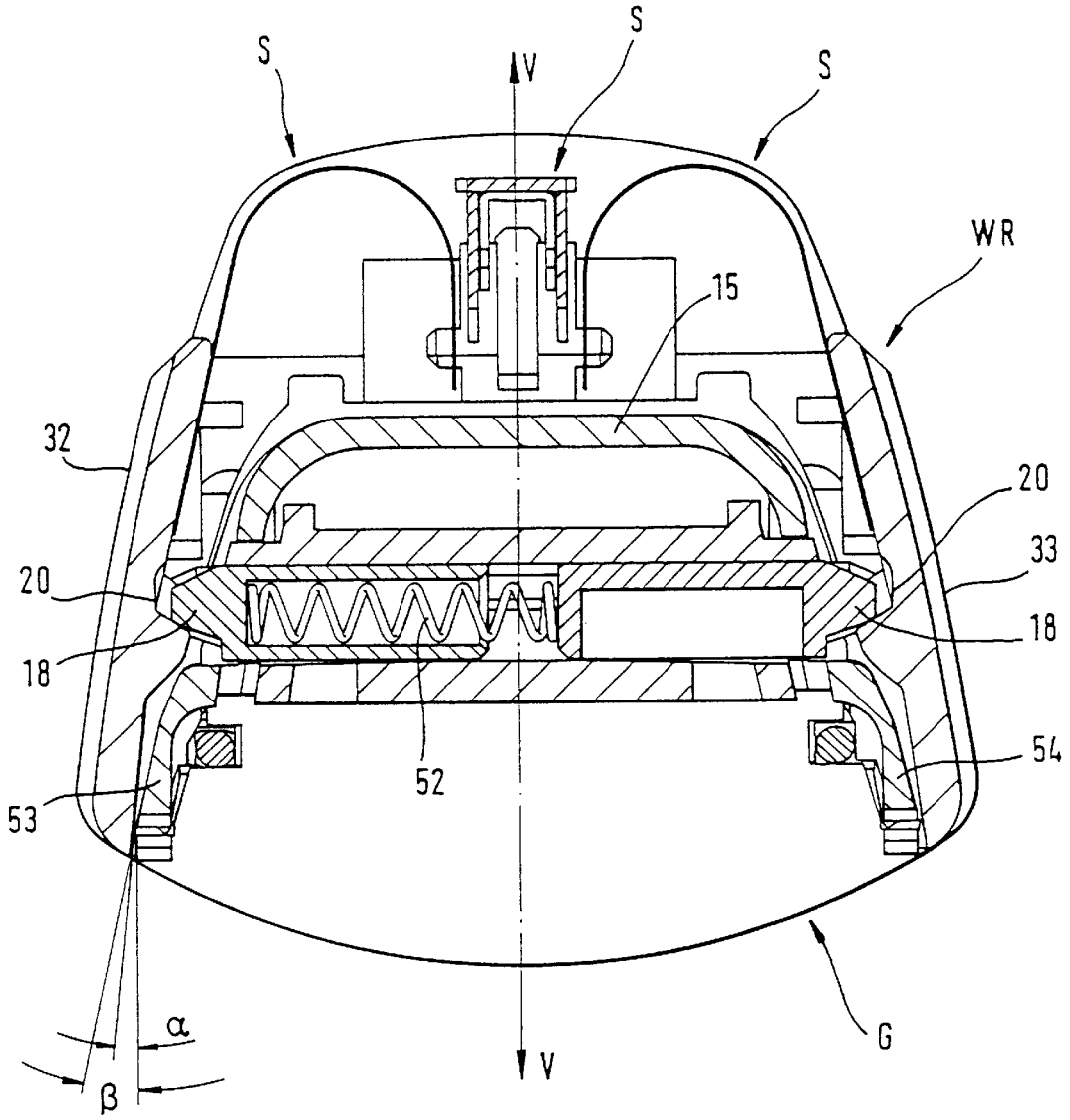
FIG. 7 is a sectional view of the housing part in the area of detent elements and of the detent notches provided in the removable frame.

FIG. 7 shows a sectional view of the housing part G in the area of the detent elements 18 movable in relative opposite direction in the housing part G and their associated detent notches 20, as well as of the removable frame WR receiving, in the embodiment shown in this Figure, the outer cutters 25 and 26 of a respective short hair cutter unit KHS and also a long hair cutter unit. Formed in the bars 32, 33 extending in the longitudinal direction of the removable frame WR—see FIG. 5—is a respective detent notch 20, 21 having at least one sloping seating surface for engagement with a respective detent element 18. Seated between the two detent elements 18 is a spring element 52 by means of which the two detent elements 18 are held in a locked position in which they protrude from the respective longitudinal side wall 53 and 54 of the housing part G. When the removable frame WR is removed from the housing part G, the sloping surfaces of the detent notches 20 exert a pressure on the detent elements 18 which project from the housing part G a small amount, moving the detent elements in opposition to the pressure of the spring element 52 into the interior of the housing part G until the bars 32 and 33 have traveled past all detent elements 18 and 19 provided, in order to be subsequently held in the holding position provided by the retaining device HV—see FIG. 5.

Figure 8:
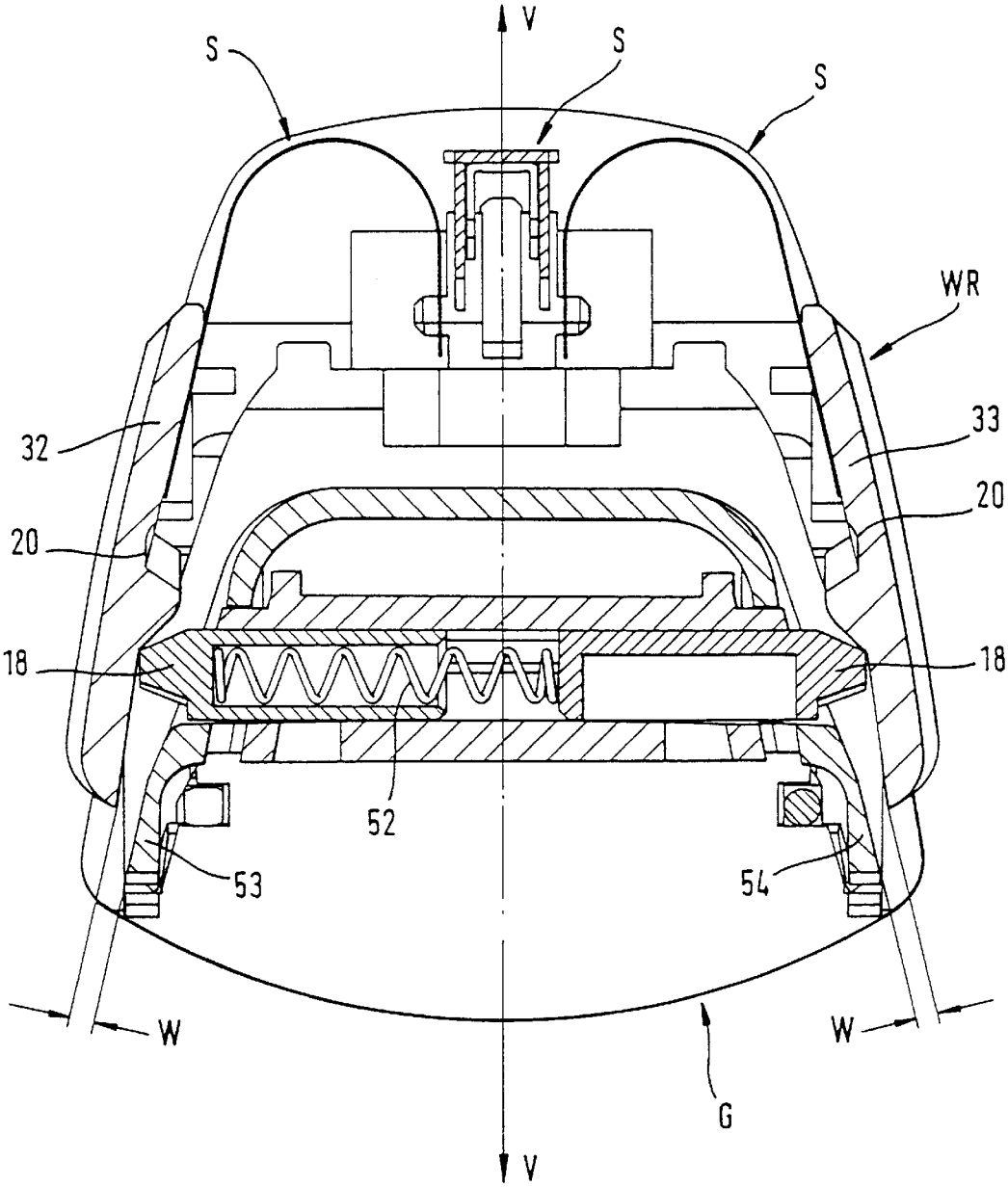
FIG. 8 is a cross-sectional view of the housing part and the removable frame, showing the removable frame in a position in which it is disengaged from the detent elements.

With the removable frame WR in the holding position HV, the detent notches 20, 21 of the removable frame WR are above the detent elements 18, 19 projecting from the housing part G—see FIG. 8. By shaping adjacent walls of the housing part G and of the removable frame WR differently, a distance W allowing the passage of hair dust results between the wall of the respective bar 32, 33 and the respective neighboring wall of the housing central portion 15 of the housing part G.

The longitudinal side walls 53, 54 of the housing central portion 15 extend in wedge shape, that is, at an inclination towards the vertical center axis V, with the area of cross section of the housing central portion 15 tapering in the direction of the cutter elements S provided. The inner walls of the bars 32, 33 of the removable frame WR differ from this shape by being constructed such that on transfer of the removable frame WR from the locked position to the holding position a distance W is producible between at least one longitudinal side wall 53, 54 of the housing part G and at least one wall of a bar 32, 33 of the removable frame WR. This may be accomplished, for example, by aligning the wall of the bar 32, 33 either parallel to the center axis V—not shown—or at an inclination to the center axis V, the latter at a wedge angle a smaller than the wedge angle P defined between the longitudinal side wall 53, 54 of the housing part G and the vertical center axis—see FIG. 7 and FIG. 8.

We claim:

1. A powered shaving apparatus, comprising a housing having a shaver head portion including a frame-supporting region, an electrically powered drive member disposed in the housing, a releasable frame carried on the frame-supporting region, at least one cutter element coupled to the drive member, said frame being adjustable between a first shaving position, in which said frame is substantially nonmovably mounted relative to said frame-supporting region during shaving operation, and a second released position, in which said frame is retained on said frame-supporting region in displaceable engagement with said frame-supporting region for facilitating cleaning, at least one first pair of cooperating retaining elements, a first said retaining element being connected to the drive member and a cooperating second said retaining element being disposed on the frame, said at least first pair of cooperating retaining elements being engaged in the second released position, and wherein in the second released position the drive member is coupled to the frame and agitates the frame to loosen shaving debris.

2. The shaving apparatus of claim 1, wherein the second said retaining element is disposed on the at least one cutter element.

3. The shaving apparatus of claim 1, wherein the frame extends along a major longitudinal axis, the displaceable agitation of the frame being substantially parallel the longitudinal axis.

4. The shaving apparatus of claim 3, wherein the second said retaining element is disposed on the at least one cutter element.

5. The shaving apparatus of claim 1, wherein the frame carries the at least one cutter element.

6. The shaving apparatus of claim 1, wherein in said second released position there is at least one gap defined by a spaced distance between a wall of the releasable frame and a confronting wall of the head portion.

7. The shaving apparatus of claim 1, wherein said second released position is spatially removed from said first position of operation.

8. The shaving apparatus of claim 1, wherein said second position is a non-shaving position.

9. The shaving apparatus of claim 1, wherein the second said retaining element comprises two latching elements.

10. The shaving apparatus of claim 1, wherein the at least one first pair of retaining elements comprises two said pairs of retaining elements, the two pairs comprising respective two first retaining elements and respective cooperating two second retaining elements.

11. The shaving apparatus of claim 1, wherein in the first shaving position, the at least one first pair of cooperating retaining elements are at least partially engaged.

12. The shaving apparatus of claim 1, further comprising a coupling member attached to the drive member, the first said retaining element being disposed on the coupling member, the coupling member being attachable in driving relation to the at least one cutter element.

13. The shaving apparatus of claim 1, further comprising a first detent element disposed on the frame and a cooperating second detent element disposed on the shaver head portion, said first and second cooperating detent elements being engaged in the first shaving position.

14. The shaving apparatus of claim 1, wherein the at least one cutter element comprises an outercutter and an undercutter in hair shearing relation.

15. The shaving apparatus of claim 14, wherein the second said retaining element is disposed on the undercutter.

16. The shaving apparatus of claim 14, wherein the frame carries the at least one cutter element.

17. The shaving apparatus of claim 14, wherein the at least one cutter element is configured as a long hair trimmer mounted in the frame.

18. The shaving apparatus of claim 14, wherein the frame carries the outercutter.

19. The shaving apparatus of claim 18, wherein the outercutter is a perforate foil cutter.

20. The shaving apparatus of claim 1, wherein the releasable frame is replaceably separable away from the head portion, whereby the at least one first pair of cooperating retaining elements are disengaged.

21. The shaving apparatus of claim 1, wherein the head portion is movable relative to the housing.

22. A dry shaving apparatus comprising an electric drive mechanism (A) provided in a housing (1) and a housing part (G) in which a frame (WR) equipped with at least one cutter element (S) is held by at least one detent mechanism (R), wherein upon release of the frame (WR) by the detent mechanism (R) the frame (WR) is movably held in a holding position by a retaining structure (HV), that in said holding position at least one gap is defined by a distance (W, W1) between a wall of the frame (WR) and a confronting wall of the housing part (G) and that the frame (WR) is drivable by the drive mechanism (A).

23. The dry shaving apparatus as claimed in claim 1, wherein the frame (WR) is detachably held by the retaining structure (HV).

24. The dry shaving apparatus as claimed in claim 22, wherein in the holding position of the frame (WR) the gap comprises a distance (W) between a wall of a housing central portion (15) and a wall of at least one bar (32, 33) of the frame (WR).

25. The dry shaving apparatus as claimed in claim 22 wherein in the holding position of the frame (WR) the gap comprises a distance (W) between an end wall (34, 35) of the frame (WR) and an end wall (13, 14) of the housing part (G).

26. The dry shaving apparatus as claimed in claim 1, wherein said distance (W) is producible by shaping adjacent walls of the housing part (G) and of the frame (WR) differently.

27. The dry shaving apparatus as claimed in claim 1, wherein said distance (W) is producible by constructing at least one wall of the housing part (G) in wedge shape to ensure detachment of the frame (WR) from the housing part (G).

28. The dry shaving apparatus as claimed in claim 1, wherein said distance (W) is producible by constructing at least one wall of the housing part (G) and an adjacent wall of the frame (WR) in wedge shape to ensure detachment of the frame (WR) from the housing part (G).

29. The dry shaving apparatus as claimed in claim 1, wherein at least one end wall (13, 14) of the housing part (G) has a wedge-shaped configuration.

30. The dry shaving apparatus as claimed in claim 1, wherein at least one end wall (34, 35) of the frame (WR) has a wedge-shaped configuration.

31. The dry shaving apparatus as claimed in claim 22, wherein at least one end wall (34, 35) of the frame (WR) and at least one end wall (13, 14) of the housing part (G) have a wedge-shaped configuration.

32. The dry shaving apparatus as claimed in claim 22, wherein the electric drive mechanism (A) is adapted to be coupled via a coupling element (K) to the at least one cutter element (S) and by cooperating retaining elements (28, 29, 30, 31) of the retaining structure (HV) to the frame (WR).

33. The dry shaving apparatus as claimed in claim 22, wherein the cutter element is coupled to the drive mechanism, and the frame (WR) held by the retaining structure (HV) is adapted to be set in motion by the cutter element.

34. The dry shaving apparatus as claimed in claim 1, further comprising a stop (40, 41) provided on at least one end wall (34, 35) of the frame (WR), said stop being acted upon in pulse fashion by a drivable cutter element.

35. The dry shaving apparatus as claimed in claim 1, further comprising a stop (42, 43) provided on at least one outer surface (38, 39) of the frame (WR), said stop acting upon an end wall (13, 14) of the housing part (G) in pulse fashion.

36. The dry shaving apparatus as claimed in claim 1, wherein the retaining structure (HV) comprises at least two retaining elements adapted to be coupled to each other.

37. The dry shaving apparatus as claimed in claim 36, wherein a first of the at least two retaining elements (28, 29) is provided on a coupling element (K) attached to the drive mechanism.

38. The dry shaving apparatus as claimed in claim 36, wherein a second of the at least two retaining elements (30, 31) is provided on a drivable cutter element.

39. The dry shaving apparatus as claimed in claim 36, wherein a second of the at least two retaining elements (30, 31) is provided on a coupling element (46) of the cutter element.

40. The dry shaving apparatus as claimed in claim 1, wherein the retaining structure (HV) comprises at least one retaining element (30, 31) of a fork-shaped configuration.

41. The dry shaving apparatus as claimed in claim 40, wherein fork arms (50, 51) of the retaining element (30, 31) are resilient.

42. The dry shaving apparatus as claimed in claim 41, wherein in a region of an opening of the fork arms (50, 51) there is at least one retaining bead (55, 56) reducing the width of the fork opening.

43. The dry shaving apparatus as claimed in claim 1, wherein the cutter element (S) is constructed as an undercutter (22) of a short hair cutter unit (KHS).

44. The dry shaving apparatus as claimed in claim 1, wherein the cutter element (S) is constructed as an undercutter (49) of a long hair cutter unit (LHS).

45. The dry shaving apparatus as claimed in claim 1, wherein a coupling element (K) of the drive mechanism is adapted to be coupled with a drivable coupling element (11) disposed in the housing part.

46. The dry shaving apparatus as claimed in claim 45, wherein the coupling element (11) in the housing part defines a groove (12) for engagement with a drive pin (10) of the electric drive mechanism (A) for the transmission of a driving motion.

47. The dry shaving apparatus as claimed in claim 1, wherein the detent mechanism (R) comprises at least one resilient detent element (18, 19) and at least one detent notch (20, 21) cooperating with the detent element (18, 19).

48. The dry shaving apparatus as claimed in claim 47, wherein the at least one detent element (18, 19) is biased by a spring element (52).

49. The dry shaving apparatus as claimed in claim 47, wherein the at least one detent element (18, 19) is provided in the housing part (G).

50. The dry shaving apparatus as claimed in claim 47, wherein the at least one detent notch (20, 21) is defined in at least one bar (32, 33) of the frame (WR).

51. The dry shaving apparatus of claim 22, wherein the housing part (G) is movable relative to the housing (1).

52. A releasable frame for a powered shaving apparatus having a housing defining a shaver head region and including a drive mechanism connected to a coupling member, said releasable frame comprising a frame housing adapted to be releasably attached to the shaver head region of the shaving apparatus, at least one cutter element supported on said frame housing and, in a first shaving position of the frame housing being mounted substantially nonmoveable to the shaver head region, being adapted to be driven in hair shearing relation by the drive mechanism, and at least one retaining element adapted to be engaged to the coupling member and therewith to the drive mechanism in at least a second position of the frame housing, wherein in said second position said retaining element is adapted to retain the frame housing to the shaver head region in displaceable relation to the shaver head region, and wherein in the second position the frame is coupleable to the drive mechanism to be agitated relative to the shaver head region to loosen shaving debris.

53. The releasable frame of claim 52, wherein the at least one retaining element is disposed on the at least one cutter element.

54. The releasable frame of claim 52, wherein the at least one cutter element comprises an undercutter, the at least one retaining element being disposed on the undercutter.

55. The releasable frame of claim 52, wherein the frame housing has a major longitudinal axis and the at least one retaining element is adapted to be agitated in a direction substantially parallel to the longitudinal axis in engagement with the coupling member.

56. The releasable frame of claim 52, wherein the at least one cutter element further has a coupling surface adapted to be coupled to the coupling member to be thereby driven by the drive mechanism.

57. The releasable frame of claim 52, wherein the at least one retaining element comprises two latch elements.

58. The releasable frame of claim 52, wherein the at least one cutter element comprises an outercutter and an undercutter in hair shearing relation.

59. The releasable frame of claim 58, wherein the at least one retaining element is disposed on the undercutter.

60. The releasable frame of claim 58, wherein the at least one cutter element is configured as a long hair trimmer mounted in the frame.

61. The releasable frame of claim 52, wherein the second position of the frame housing is spaced from said first shaving position.

62. The releasable frame of claim 52, further comprising a detent element disposed on the frame, said detent element adapted to be engaged with a cooperating second detent element disposed on the shaver head region, said first and second cooperating detent elements being engaged in the first shaving position to hinder motion of the frame relative to the shaver head region.

63. A method of cleaning a powered shaving apparatus that has accumulated shaving debris after having shaved a hairy skin surface, comprising the steps of providing a powered shaving apparatus having a drive mechanism and a shaving head region comprising at least one cutter element and a frame selectively positionable between a first shaving position supported on the shaving head region and a second released position supported on the shaving head region, mounting the frame in the shaving position substantially immovable relative to the shaving head region suitable for a shaving operation, releasing the frame from the shaving position, displacing the frame to the second position, retaining, in the second position, the frame in moveable relation on the shaving head region, agitating the frame with the drive mechanism, whereby debris accumulated from shaving is loosenable from the shaving apparatus.

64. The method of claim 63, wherein the step of providing includes the frame having a major longitudinal axis, and the step of agitating being directed substantially parallel to the longitudinal axis.

65. The method of claim 63, wherein the step of displacing the frame to the second position comprises spacing the frame from the shaving head region so as to define a gap therebetween.

66. The method of claim 63, wherein the step of movably retaining the frame in the second position comprises releasably retaining the frame to the drive mechanism.

67. The method of claim 63, wherein the step of providing includes the at least one cutter element being carried on the frame.

68. The method of claim 67, wherein the providing step further comprises providing the at least one cutter element with a retaining element, and the step of retaining in the second position further comprises engaging the retaining element to the drive mechanism.

69. The method of claim 68, wherein the step of providing further includes the at least one cutter element comprising an undercutter, and the retaining element being carried on the undercutter.

70. The method of claim 63, wherein the step of displacing the frame to the second position comprises lifting the frame relative the shaving head region.

71. The method of claim 63, wherein the step of releasing the frame from the shaving position causes the frame to displace towards the second position for cleaning.

72. The method of claim 63, wherein the step of mounting the frame in the shaving position includes latching the frame to a detent mechanism.

* * * * *

UNITED STATES PATENT AND TRADEMARK OFFICE

CERTIFICATE OF CORRECTION

PATENT NO. : 6,381,849 B2
DATED : May 7, 2002
INVENTOR(S) : Eichhorn et al.

It is certified that error appears in the above-identified patent and that said Letters Patent is hereby corrected as shown below:

Column 10,
Line 9, change "claim 1" to -- claim 22 --;
Line 20, change "claim 1" to -- claim 22 --;
Line 24, change "claim 1" to -- claim 22 --;
Line 28, change "claim 1" to -- claim 22 --;
Line 33, change "claim 1" to -- claim 22 --;
Line 36, change "claim 1" to -- claim 22 --;
Line 53, change "claim 1" to -- claim 22 --;
Line 56, change "claim 1" to -- claim 22 --;
Line 61, change "claim 1" to -- claim 22 --;

Column 11,
Line 3, change "a drivable" to -- the --;
Line 8, change "claim 1" to -- claim 22 --;
Line 17, change "claim 1" to -- claim 22 --;
Line 20, change "claim 1" to -- claim 22 --;
Line 23, change "claim 1" to -- claim 22 --; and
Line 32, change "claim 1" to -- claim 22 --.

Signed and Sealed this

Eighth Day of October, 2002

*Attest:*

*Attesting Officer*

JAMES E. ROGAN
*Director of the United States Patent and Trademark Office*